US008562051B2

(12) United States Patent
Swanepoel

(10) Patent No.: US 8,562,051 B2
(45) Date of Patent: Oct. 22, 2013

(54) DISPOSAL UTENSIL

(76) Inventor: Dawid Lukas Frederik Swanepoel, Pretoris (ZA)

( * ) Notice: Subject to any disclaimer, the term of this patent is extended or adjusted under 35 U.S.C. 154(b) by 0 days.

(21) Appl. No.: 13/146,872

(22) PCT Filed: Jan. 18, 2010

(86) PCT No.: PCT/ZA2010/000002

§ 371 (c)(1),
(2), (4) Date: Jul. 28, 2011

(87) PCT Pub. No.: WO2010/088704

PCT Pub. Date: Aug. 5, 2010

(65) Prior Publication Data

US 2011/0285154 A1 Nov. 24, 2011

(30) Foreign Application Priority Data

Jan. 30, 2009 (ZA) ..... 2009/0725

(51) Int. Cl.
*E01H 1/12* (2006.01)
*B08B 3/02* (2006.01)

(52) U.S. Cl.
USPC ..... 294/176; 294/1.3

(58) Field of Classification Search
USPC ..... 294/1.3, 1.4, 1.5, 176, 49, 51, 59; 141/98, 108, 382, 389, 391
See application file for complete search history.

(56) References Cited

U.S. PATENT DOCUMENTS

| | | | | | |
|---|---|---|---|---|---|
| 133,562 | A | * | 12/1872 | Chaffin | 141/314 |
| 192,987 | A | * | 7/1877 | Griffiths | 294/180 |
| 220,576 | A | * | 10/1879 | Chilis | 141/98 |
| 3,139,299 | A | * | 6/1964 | Bowen | 294/1.4 |
| 3,490,501 | A | * | 1/1970 | Rene et al. | 141/84 |
| 4,646,795 | A | * | 3/1987 | Hebron et al. | 141/98 |
| 4,741,566 | A | | 5/1988 | Byung-Do | |
| 4,744,380 | A | * | 5/1988 | Sheriff | 134/198 |
| 4,856,823 | A | * | 8/1989 | Heren | 285/81 |
| 5,360,247 | A | * | 11/1994 | Vachter | 294/1.4 |
| 5,660,421 | A | * | 8/1997 | Krenzler | 294/51 |
| 6,325,425 | B1 | * | 12/2001 | Kierath et al. | 285/352 |
| 7,762,596 | B1 | * | 7/2010 | Gaydos et al. | 294/1.5 |

* cited by examiner

*Primary Examiner* — Dean Kramer
(74) *Attorney, Agent, or Firm* — Michael P. Pettit

(57) ABSTRACT

The invention provides a utensil 10 includes a body 12 and a water entry point 14. The body 12 is in the form of a scoop and is fabricated from a thermoplastic polymer, e.g. Polyvinyl chloride. The body 12 is substantially cylindrical in shape and is typically truncated along its length. The inner portion of the body 12 defines a scoop-like excrement receiving surface 16 which extends from a free end region 18 of the body 12. Water is then supplied via the entry point 14 into the body 12 at a pressure sufficient to discharge the excrement received therein and disposed of into the drainage system.

2 Claims, 3 Drawing Sheets

DISPOSAL UTENSIL

FIELD OF THE INVENTION

This invention relates to a disposal utensil for disposing of waste.

SUMMARY OF THE INVENTION

According to an aspect of the invention there is provided a disposal utensil which includes:

a body defining a surface for receiving waste; and at least one water entry point arranged on the body for discharging water there through to thereby flush the waste from the body.

For the purposes of this specification the term "waste" shall be construed to include any flushable waste material for example excrement, a dead bird, hazardous material, and the like.

The body may include a scoop.

The scoop may be shaped and dimensioned to at least span a diameter of a pipe. Such a pipe may form part of a standardised drainage system, to thus house a portion the body during flushing of the waste.

The body may include a cap arranged at an end region, which cap is shaped and configured to be of a diameter at least greater that the inner diameter of the pipe. This arrangement allows the cap to cover the pipe with the portion housed inside the pipe during flushing of the waste thereby reducing or avoiding splashing onto the user The body may include a hollow handle extending from the body. The water entry point may be located at a juncture between the surface and handle.

The water entry point may be shaped and configured to discharge water onto the surface at an angle of from 90 to about 360 degrees to rinse or flush waste received therein. Typically the water is discharged onto the surface in an arc similar to that of the scoop surface.

The handle may include an engagement portion for engaging with a connector, for example an adjustable garden hose fitting commonly referred to as a Gardena™ jet nozzle, a screw and thread arrangement, or the like. The engagement portion may be shaped and configured to engage with the connector, for example the engagement portion may form a mating fit with the Gardena™ click on fitting, or integrally moulded with the handle.

Where the engagement portion is a screw thread, either a hose pipe fitting having a mating screw thread can be used to attach the hose to the handle, or a snap-on type fitting commonly used on a water tap can be screwed thereon and the hosepipe connected using the snap-on type fitting, for example, a Gardena™ fitting.

The connector may be connectable to a water source by means of a second connector located on a hose pipe or the like. The connector may be configured to engage with the second connector, for example a hose tail connector commonly referred to as the Gardena™ hose tail connector.

BRIEF DESCRIPTION OF THE DRAWINGS

The invention is now described, by way of non-limiting example, with reference to the accompanying drawings wherein.

DETAILED DESCRIPTION OF THE INVENTION

Figure 1:
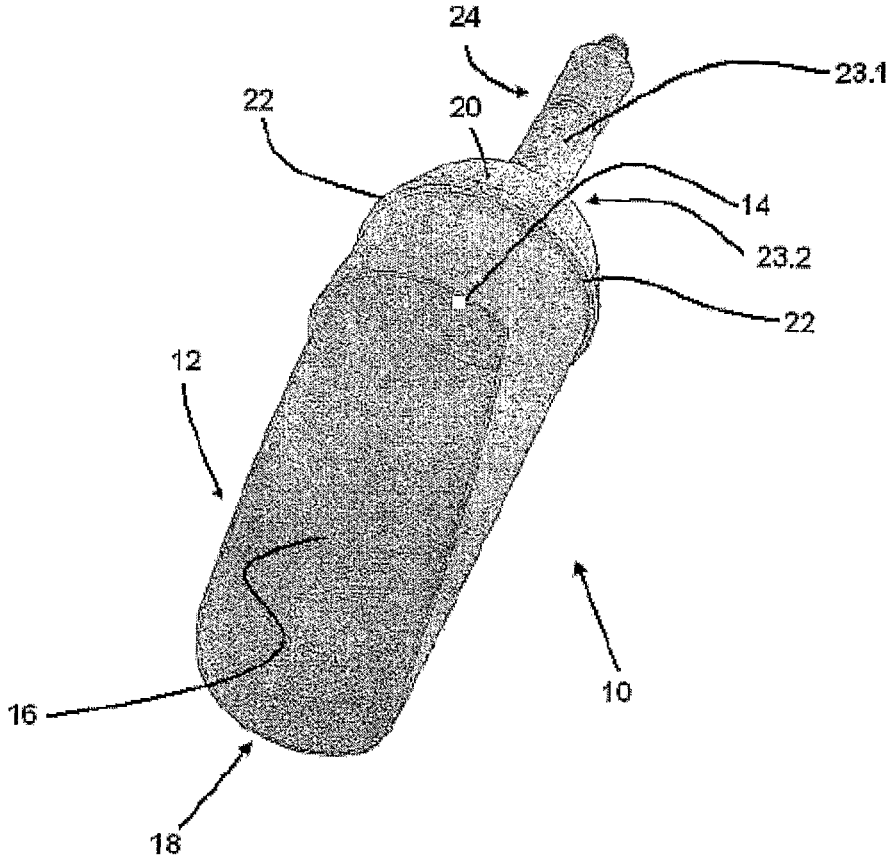
FIG. 1 shows, in diagrammatic view, a disposal utensil, in accordance with the invention.
Figure 2:
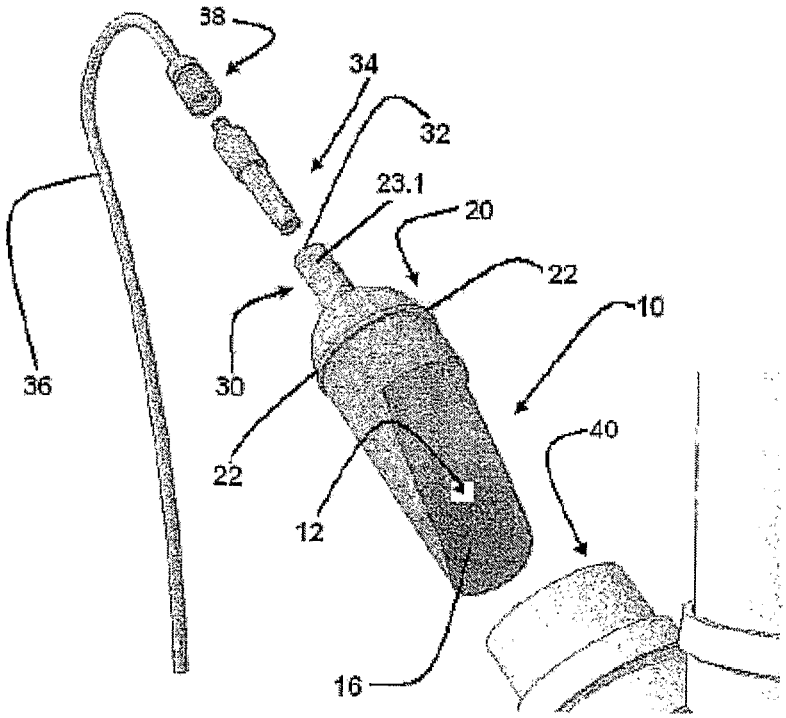
FIG. 2 shows, in diagrammatic view, the utensil of FIG. 1, in use.

With reference to the accompanying FIGS. 1 and 2, a disposal utensil, in accordance with the invention, is generally indicated by reference numeral 10.

In the embodiment of the invention shown, the utensil 10 includes a body 12 and a water entry point 14.

The body 12 is in the form of a scoop and is fabricated from a thermoplastic polymer, e.g. Polyvinyl chloride. The body 12 is substantially cylindrical in shape and is typically truncated along its length. The inner portion of the body 12 defines a scoop-like excrement receiving surface 16 which extends from a free end region 18 of the body 12.

A cap 20 is arranged to extend from the body with its circumferential extending edges 22 proud of the body 12. The cap 20 is dome-like in shape and has a handle 23.1 extending from a dome apex 23.2. The entry point 14 is located at a juncture region between the surface 16 and handle 23.1.

The handle 23.1 is cylindrical in nature and extends from an end region 24 opposite the free end region 18. The handle 23.1 is hollow in nature for allowing water to enter the body 12 via the point 14. The inner portion of the handle 23.1 defines a passage which receives water there through to thus charge the body 12 with water.

A free end 30 of the handle 23.1 defines an engagement portion 32 for engaging with a connector 34 in the form of an adjustable jet nozzle. The connector 34 is typically frustaconical in shape and forms a mating fit with the engagement portion 32.

In an embodiment of the invention not shown in the figures, the connection 34 forms an integral part of the handle 23.1, for example, by being moulded as a unit.

The connector 34 is connectable to a water source by means of a hose pipe 36, and the connector 34 is configured to connect with a second connector 38, in the form of a hose tail connector, located on the pipe 36.

In use, a user utilises the utensil 10 to collect excrement onto the receiving surface 16. The user would then take the excrement to a pipe 40, which forms part of a soil drainage system. A portion of the body 12 is inserted into the pipe 40 until the cap 20 abuts about the pipe 40. The user then connects the hose pipe 36 via the connectors 34 and 38, with the engagement portion 32 in position. The engagement portion 32 and the free end of the handle 23.1 are then coaxially engaged with each other to form a mating fit. Water is then supplied via the entry point 14 into the body 12 at a pressure sufficient to discharge the excrement received therein and disposed of into the drainage system via the pipe 40.

Figure 3:
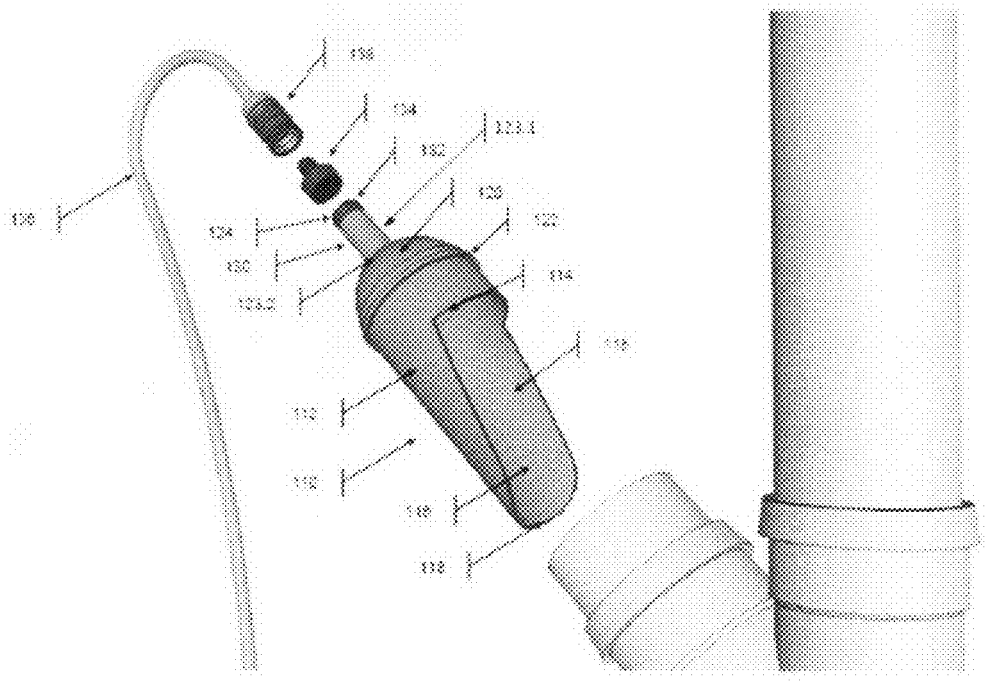
FIG. 3 shows, in diagrammatic exploded view, another embodiment of the invention in accordance with the invention.

In the embodiment shown in FIG. 3, the utensil 110 includes a body 112 and a water entry point 114.

The body 112 is in the form of a scoop and is fabricated from a thermoplastic polymer, e.g. Polyvinyl chloride. The body 112 is substantially cylindrical in shape and is typically truncated along its length. The inner portion of the body 112 defines a scoop-like excrement receiving surface 116 which extends from a free end region 118 of the body 112.

A cap portion 120 is arranged to extend from the body with its circumferential extending edges 122 proud of the body 112. The cap 120 is dome-like in shape and has a handle 123.1 extending from a dome apex 123.2. The entry point 114 is located at a free end of the handle 123.1.

The handle 123.1 is cylindrical in nature and extends from an end region 124 opposite the free end region 118. The handle 123.1 is hollow in nature for allowing water to enter the body 112 via the point 114. The inner portion of the handle 123.1 defines a passage which receives water there through to thus charge the body 112 with water.

A free end 130 of the handle 123.1 defines a screw threaded engagement portion 132 for engaging with the female screw threaded portion of a male portion of a snap-on connector 134.

The connector 134 is connectable to a second connector 138 of the Gardena™ type which is attached to the end of a hose pipe 136 whereby water is provided.

The utensil 110 is used in a similar manner to that described for FIGS. 1 and 2 above.

Although only certain embodiments of the invention have been described herein, it will be understood by any person skilled in the art that other modifications, variations, and possibilities of the invention are possible. Such modifications, variations and possibilities are therefore to be considered as falling within the spirit and scope of the invention and hence forming part of the invention as herein described and/or exemplified.

It shall further be understood that the examples are provided for illustrating the invention further and to assist a person skilled in the art with understanding the invention and is not meant to be construed as unduly limiting the reasonable scope of the invention.

The Inventors regard it as an advantage that the invention provides for a more convenient and simpler way of discarding of excrement. The Inventors regard it as a further advantage that the invention provides for health benefits since the user does not have to further clean the utensil. The Inventors regard it as a further advantage that the invention enables manufacture of a robust disposal utensil.

The invention claimed is:

1. A disposal utensil comprising:

a body defining a surface for receiving waste in the form of a scoop, some or all of the surface for receiving waste being shaped and dimensioned to fit within a pipe which forms part of a standardised drainage system;

at least one water entry point being connected to a water source, the water entry point being arranged on the body for discharging water there through at a pressure sufficient to flush the waste from the surface for receiving waste; and a cap portion having a circumferential protruding edge provided on the body, the circumferential protruding edge having a diameter greater than the inner diameter of the pipe and being operable to substantially abut about the pipe and thereby cover the surface for receiving waste within the pipe and thereby reduce or avoid splashing.

2. A waste disposal method comprising:

receiving waste on a body defining a surface in the form of a scoop, some or all of the surface being shaped and dimensioned to fit within a pipe which forms part of a standardised drainage system, the body additionally having a cap portion provided thereon, the cap portion having a circumferential protruding edge with a diameter greater than the inner diameter of the pipe;

positioning the waste receiving surface within the drainage pipe opening, with the protruding edge substantially abutting out over the circumferential pipe cross section and thereby covering the surface for receiving waste within the pipe, thereby reducing or avoiding splashing in use;

connecting a pressurized water source to at least one water entry point, the water entry point being arranged on the body for discharging water there through over the surface for receiving waste at a pressure sufficient to flush the waste therefrom.

* * * * *